United States Patent [19]

Wilson et al.

[11] 4,209,114

[45] Jun. 24, 1980

[54] DISPENSING CLOSURE STRUCTURES

[75] Inventors: Woodrow S. Wilson, Johnston; Benjamin Gryncewicz, Lincoln, both of R.I.

[73] Assignee: Polytop Corporation, Slatersville, R.I.

[21] Appl. No.: 863,402

[22] Filed: Dec. 22, 1977

[51] Int. Cl.[2] ..... B67D 3/00

[52] U.S. Cl. ..... 222/536; 222/556; 220/254; 220/338; 403/67

[58] Field of Search ..... 200/277, 67 AA, 335, 200/339; 403/67; 222/533-536, 538, 539, 540, 526-528, 530, 531, 484, 556, 517, 557, 558, 498; 220/337, 338, 342, 254; 248/289-294; 16/DIG. 13, 171; 215/311, 235; 285/DIG. 22, 273, 224, 264

[56] References Cited

U.S. PATENT DOCUMENTS

| | | | |
|---|---|---|---|
| Re. 21,673 | 12/1940 | Murad | 200/339 |
| 1,250,081 | 12/1917 | Bennis | 222/536 |
| 2,765,949 | 10/1956 | Hillman | 220/338 |
| 3,086,676 | 4/1963 | Dilatush | 220/338 |
| 3,718,238 | 2/1973 | Hazard et al. | 222/538 |
| 4,124,151 | 11/1978 | Hazard | 222/556 |

*Primary Examiner*—H. Grant Skaggs
*Attorney, Agent, or Firm*—Edward D. O'Brian

[57] ABSTRACT

It is known to manufacture closure structures so that each of such structures has a cap part including two spaced, aligned bearings and a movable part extending between the bearings and including trunnions fitting within the bearings. At least one of the parts of such closure structures is formed of a material which is sufficiently resilient so that the trunnions may be snapped into the bearings during the assembly of the closure structure. Such a closure structure may be improved so as to reduce damage to one or both of the parts during the manufacture of such a closure structure by shaping the trunnions and the bearings so that they both have shapes of surfaces of revolution which decrease in diameter in accordance with the distance from the portion of the movable part fitting within and between the spaced bearings. The entrances employed should also decrease in width in a corresponding manner.

4 Claims, 5 Drawing Figures

DISPENSING CLOSURE STRUCTURES

BACKGROUND OF THE INVENTION

The invention set forth in this specification pertains to new and improved dispensing closure structures. Specifically it pertains to dispensing closure structures employing bearings and trunnions of a specialized shape and configuration as hereinafter indicated for mounting a movable part such as a spout upon a cap part.

The term or expression "dispensing closure" is currently used to designate a two or more piece closure structure which is constructed so as to include a cap or cap part either adapted to be mounted upon a conventional container, or to be formed integrally with such container and a movable part such as a spout or lid pivotally mounted on such a cap part so as to be capable of being moved between open and closed positions. These closures have normally been constructed so as to include bearing openings or cavities in the cap part having restricted entrances enabling the movable parts of such closures to be snapped in place within such bearing openings during the assembly of such closures.

In order to achieve such a manner or mode of assembly it is, of course, necessary to manufacture at least one of the parts of such a closure of a resilient material capable of temporary deformation during closure assembly. It has been commonplace to manufacture both of the parts used in such a closure of such a material. Such closures have been manufactured in tremendous numbers with both of such parts being constructed of a comparatively soft, resilient material such as low density or non-linear polyethylene. When such parts are manufactured of polyolefin material they have, of course, been manufactured by conventional injection molding techniques.

While low density polyethylene is a very effective desirable material for use in manufacturing dispensing closure structures this material is nevertheless considered undesirable in some applications. It is not considered that an understanding of the present invention requires a detailed discussion of the reasons for this. For essentially commercial type reasons at the present time it is frequently desired to manufacture dispensing closures so that one or both of the parts of such closures are formed out of a comparatively hard but yet somewhat resilient polyolefin polymer such as linear or high density polyethylene or polypropylene.

Although known types of dispensing closures have been manufactured out of such comparatively hard materials, problems have been encountered during the manufacture of closures using such materials. On occasion during the molding of the cap parts of such closures such closures have been damaged. Such damage is considered to be the result of a significant buildup of stresses and strains in cap parts adjacent to the bearing openings in such parts as such cap parts are removed from a mold and/or the parts of a mold creating such bearing openings and the entrances to them. This damage is considered to be related to the limited resiliency and flexibility of such relatively hard materials and the stress concentrations within them as they are removed from a mold and/or mold part.

Further, on occasion the cap part and/or the trunnions of the movable parts of such dispensing closures in which one or both of such parts are formed out of a comparatively hard polymer material have been damaged for substantially the same reasons. Such damage is considered to be the result of an absence or lack of sufficient resiliency and flexibility in one or both of such parts to accommodate the trunnions on the movable parts being snapped or popped into position without material being damaged.

SUMMARY OF THE INVENTION

As a result of these considerations it has been realized that a need exists for new and improved dispensing closure structures. A broad objective of the present invention is to fulfill this need. A more specific objective of the present invention is to provide new and improved dispensing closure structures which are of such a character that the parts for such structures may be manufactured out of a comparatively hard polymer material without significant danger of damage as such parts are removed from the mold and which are of such a character that the parts of such closures are capable of being popped or snapped together without significant danger of damage to such parts during such assembly. A further objective of the present invention is to provide dispensing closure structures as indicated which are no more difficult and expensive to manufacture than prior related structures and which are of such a character as to be capable of prolonged, effective use.

In accordance with this invention these objectives are achieved by providing a closure structure having a cap part and a movable part, the cap part including two spaced, aligned bearing means and restricted entrances into said bearing means, said movable part extending between said bearing means and including two trunnion means, each of said trunnion means fitting within one of said bearing means, at least one of said parts being formed of a material sufficiently resilient so that said trunnion means can be snapped into said bearing means, in which the improvement comprises: each of said trunnion means having the shape of the surface of revolution which decreases in diameter in accordance with the distance from that portion of said movable part located between said bearing means, each of said bearing means having a shape which corresponds to the shape of the trunnion means within it, each of said entrances decreasing in width in accordance with the distance from the space between said bearing means and tapering downwardly into one of said bearing means.

In a presently preferred closure in accordance with this invention the cap part is constructed so that it can be attached to a container in a conventional manner. However, if desired, the cap part may be formed integrally with such a container. Although the movable part in a closure structure in accordance with this invention can consist of a lid it is presently preferred that such a movable part be constructed so as to serve as a spout which is adapted to either close off and/or be in communication with an opening through the cap part in accordance with the position of such a spout.

BRIEF DESCRIPTION OF THE DRAWING

The invention is best more fully explained with reference to the accompanying drawing in which.

Figure 1:
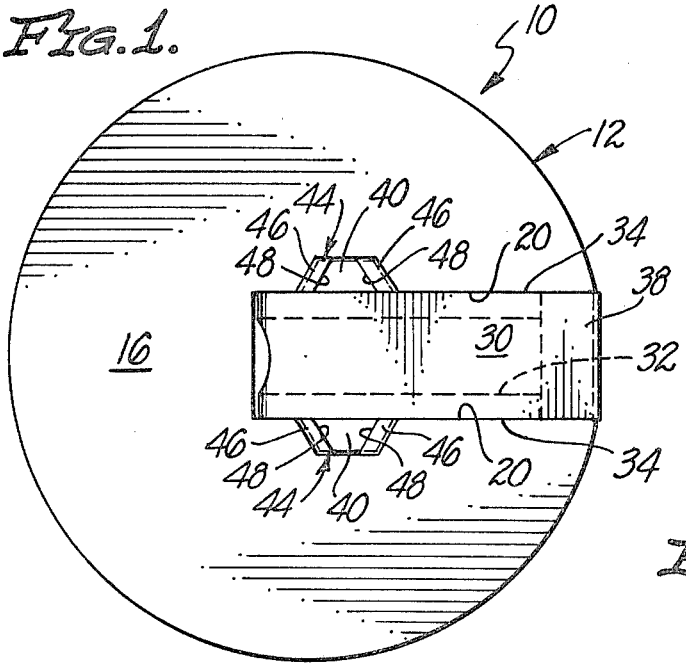
FIG. 1 is a top plan view of a presently preferred embodiment or form of a dispensing closure structure in accordance with the invention.
Figure 3:
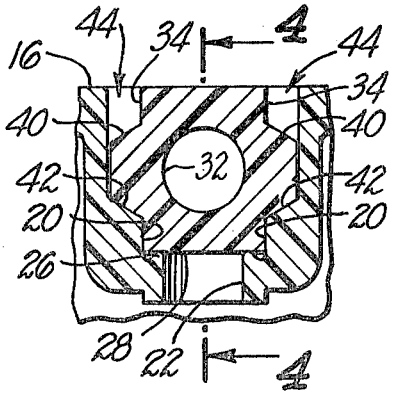
FIG. 3 is a partial cross-sectional view taken at line 3—3 of FIG. 2.
Figure 4:
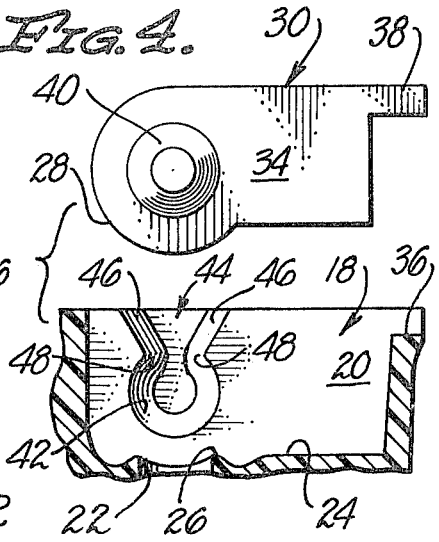
FIG. 4 is an exploded view in which a part of the cap part is shown in section along a line corresponding to the cross-sectional line 4—4 in FIG. 3 and in which the movable part is shown in side elevation.

The particular depensing closure structure illustrated is constructed so as to utilize the operative concepts or principles of the invention set forth and defined in the appended claims. Because of the nature of these concepts or principles they may be easily embodied within other somewhat differently appearing and differently constructed dispensing closure structures through the use of the routine engineering skill which is common in the dispensing closure industry.

DETAILED DESCRIPTION

In the drawing there is shown a dispensing closure 10 which includes a cap or cap part 12 formed as an integral body out of a comparatively hard, yet somewhat resilient polymer such as linear polyethylene or polypropylene so as to include a dependent internally threaded skirt 14 adapted to be secured to a conventional container (not shown) in a conventional manner. A top 16 is located on the skirt 14 so as to close off the interior (not separately numbered) of the skirt 14. This top 16 is provided with an internal elongated cavity or slot 18 having parallel, vertically oriented sides 20.

A hole 22 leads from the bottom 24 of the cavity 18 into the interior (not separately numbered) of the skirt 14. Preferably a known flexible, deformable sealing member 26 is located on the bottom 24 around the hole 22 for the purpose of forming a seal against a cylindrical surface 28 on a movable part or spout 30 employed in the closure structure 10. This spout 30 is formed of a material such as is used in the cap part 12 and is of an elongated character. It includes an elongated hole or passage 32 extending from the surface 28 along its length.

It will be noted that the spout 30 is dimensioned so as to have sides 34 which fit within, and one slightly spaced from, the sides 22 of the cavity 18 and is dimensioned so that the spout 30 is in a closed position. Preferably a notch 36 is provided in the top 16 so that a small handle-like extension 38 on the spout 30 will be accessible in order to facilitate rotation of the spout 30 from this closed position.

The spout 30 is provided with aligned, identical trunnions 40 which extend from the sides 34 of the spout 30. Each trunnion 40 is preferably shaped as the frustrum of a circular cone having approximately a 60° angle at its apex. It will be realized that such a cone is a surface of revolution which decreases in diameter along its length. The trunnions 40 are formed so as to have their largest diameters coincident with the sides 34 and so as to have their smallest diameters remote from these sides 34. It will be apparent that they decrease in diameter in accordance with the distances from the sides 34. If desired the trunnions may be shaped in other manners than as shown. Thus, effective results can be achieved when the trunnions 40 are semispheres although this is not normally preferred because of the difficulty in making molds of this shape.

Figure 2:
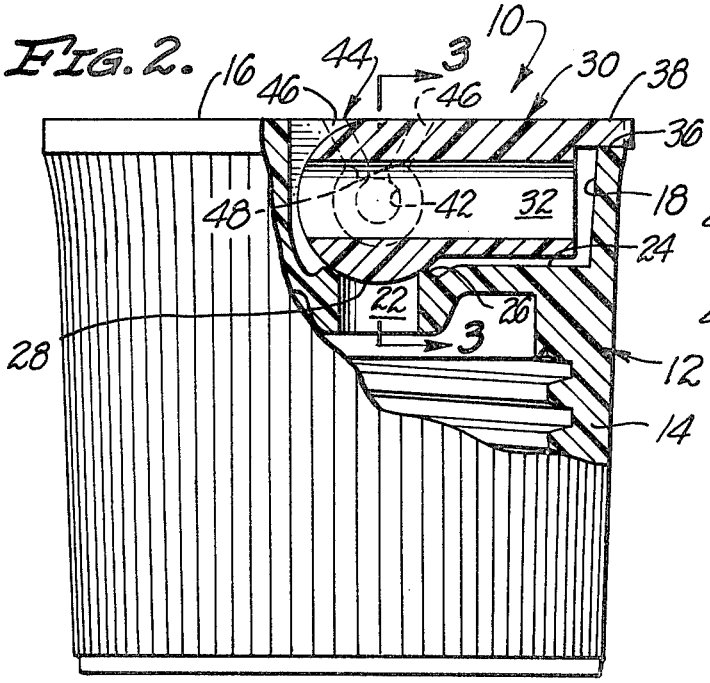
FIG. 2 is a side elevational view of the structure shown in FIG. 1 in which part of the view has been broken away so as to show internal details of the closure structure in section.
Figure 5:
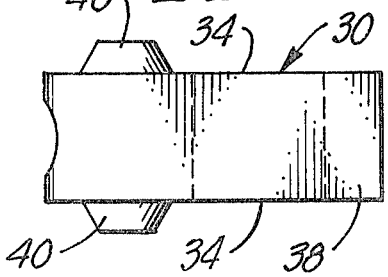
FIG. 5 is a top plan view of the movable part employed in the closure illustrated in the preceding figures.

In the described structure these sides 34 are located within identical bearing openings 42 formed in the sides 20 of the cavity 18. The bearing openings 42 are substantially of the same shape as the portions of the trunnions 40 fitting within them, and are adapted to firmly engage these trunnions 40 in such a manner that the spout 30 can be rotated from a position as shown in FIGS. 1 and 2 to an open position in which the passage 32 extends vertically in alignment with the hole 22. These bearing openings 42 also engage the trunnions 40 in such a manner that at all times the surface 28 is held against the sealing ring 26 in such a manner as to form and maintain a seal between the surface 28 and the ring 26.

The top 16 is formed so as to include identical entrances 44 into the bearing openings 42. Each of these entrances 44 includes two nearly flat, sloping walls 46 which are located at an angle with respect to one another so as to converge downwardly toward curved edges 48 marking the intersections between these walls 46 and the bearing openings 42. When viewed from the top the edges 48 appear substantially as being disposed in a V-shaped pattern or relationship. Similarly, the walls 46 appear in substantially a V-type relationship to one another as viewed from within the cavity 18.

This particular type of construction has some significant advantages. The shape of the bearing openings and the entrances 44 is such that a cap part 12 may be easily disengaged from the appropriate parts of a conventional injection mold used to form the cap part 12 out of a comparatively yet somewhat resilient polymer such as linear polyethylene, polypropylene or the like. Such disengagement of the cap part 12 may be accomplished without any significant danger or chance of the cap part being damaged by virtue of the construction employed.

It is considered that the reasons for this relate to the manner in which stresses and strains are transmitted in and throughout the top 16 as the bearing openings 42 and the entrances 44 are disengaged from parts of an injection mold as a cap part 12 is formed. The shape of the cap part 12 is such that such stresses and strains are not effectively concentrated in it but instead tend to be distributed in a more or less radial manner outwardly from the central region (not separately numbered) of the top 16 where the bearing openings 42 are located.

The particular shapes of the bearing openings 42 and the entrances 44 are such that the presence of comparatively sharp lines at the intersections of surfaces is minimized. This is considered to be quite desirable in minimizing the stresses and strains which might cause damage during the removal of the cap part 12 from a mold. The particular design of the cap part 12 illustrated does not completely eliminate such lines of intersection between various surfaces but minimizes the presence of such lines of intersections to a sufficient extent so as to minimize stress and strain concentration as the cap part 12 is removed from a mold to a sufficient extent so as to effectively preclude the danger of part damage during such removal.

The shape of the cap part 12 is considered to accomplish more than a minimization of lines of surface intersections where stresses and strains may be concentrated. By virtue of the shape and configuration indicated it is considered that the entire top 16 to a degree acts as a deformable, somewhat resilient or spring-like structural member which serves to "take up" forces transmitted to the cap part 12 during removal from a mold so as to minimize the chances of damage during such removal. This type of action utilizes the physical properties of the material within the cap part 12 in connection with the various individual elements of the cap part 12 illustrated and described, or as to achieve what may be regarded as a spring or spring-like action during the removal of the cap part 12 from a mold.

The particular design illustrated is also advantageous during the assembly of the spout 30 on the cap part 12 for substantially the same reasons. During such assembly significant stresses and strains are set up in the top 16 adjacent to the entrances 44 as the spout 30 is popped or snapped into position. The design illustrated minimizes such stresses and strains by providing a construction whereby they tend to be spread out in essentially a radial manner in the central region of the top 16. By minimizing the presence of comparatively sharp surface intersections concentrations of stresses and strains which might lead to damage, such as galling, tearing, etc., during assembly when there is temporary material deformation are minimized with a structure such as the structure shown. It is considered that an important factor in accomplishing this relates to the top 16 exhibiting a spring-type action corresponding to that indicated in the preceding during assembly.

We claim:

1. A closure structure having a cap part and a movable part, said cap part having a top shaped so as to include two spaced, aligned bearing means located beneath the upper surface of said top and restricted entrances leading into said bearing means, said restricted entrances leading downwardly to said bearing means from the upper surface of said top, said aligned bearing means having an axis, said movable part extending between said bearing means and including two trunnion means, each of said trunnion means fitting within one of said bearing means, at least said cap part being formed of material sufficiently resilient so that said trunnion means can be snapped into said bearing means, said cap part having an opening extending therethrough, said movable part being movable between a closed position in which it closes off said opening and an open position in which said opening is open in which the improvement comprises:

said material is a hard, somewhat resilient polymer selected from the group consisting of linear polyethylene and polypropylene, each of said trunnion means having the shape of a surface of revolution which decreases in diameter in accordance with the distance from that portion of said movable part located between said bearing means, each of said bearing means having a shape which substantially corresponds to the shape of the trunnion means within it, each of said entrances decreasing in width in accordance with the distance from the space between said bearing means and tapering downwardly into one of said bearing means, the rigidity of said cap part being such that said movable part is positioned against any movement in the direction of said axis during and after assembly of said movable part on said cap part as a result of the shapes of said entrances, said bearing means and said trunnion means, said shapes of said entrances, said bearing means and said trunnion means tending to minimize concentrations of stresses and strains and to spread stress and strains radially from the central region of said top during assembly of said movable part on said cap part, the lengths of said trunnion means being such so as to fit within said bearing means without exerting stress and strains against the ends of said bearing means of smallest dimension.

2. A closure structure as claimed in claim 1 in which:

each of said trunnion means has the shape of a frustrum of a right circular cone, and said trunnion means have identical shapes.

3. A closure structure as claimed in claim 1 in which:

said movable part is a spout having a passage extending therethrough, said cap part includes an opening extending therethrough, said spout being held by said trunnion means fitting within said bearing means so as to be capable of being rotated between a closed position in which said spout closes off said opening and an open position in which said passage is aligned with said opening, said cap part includes a flat top, said flat top including a slot formed therein, said slot having sides, said bearing means and said entrances being located so as to be in communication with the sides of said slot, that portion of said movable part fitting between said bearing means is of less width than the distance between said bearing means, each of said trunnion means has the shape of a frustrum of a right circular cone, and said trunnion means have identical shapes, each of said entrances includes two flat, sloping walls which are disposed at an angle with respect to one another so as to converge downwardly toward curved edges serving as intersections between said walls and said bearing means, said edges appearing as being disposed in a V-shaped relationship so as to be pointed outwardly from the space between said bearing means when viewed from the top of said closure, both of said parts are formed of a polymer selected from the group consisting of linear polyethylene and polypropylene.

4. A closure structure as claimed in claim 1 wherein:

both of said parts are formed of said material.

* * * * *